United States Patent [19]

Hollberg et al.

[11] Patent Number: 5,035,773

[45] Date of Patent: Jul. 30, 1991

[54] HEADBOX WITH CONCAVE AUXILIARY BLADE

[75] Inventors: Peter J. Hollberg, Richmond; James C. Swann, Waverly, both of Va.

[73] Assignee: E. I. Du Pont de Nemours and Company, Wilmington, Del.

[21] Appl. No.: 591,190

[22] Filed: Oct. 4, 1990

[51] Int. Cl.[5] ..... D21F 1/02

[52] U.S. Cl. ..... 162/347; 162/344

[58] Field of Search ..... 162/344, 347, 336

[56] References Cited

U.S. PATENT DOCUMENTS

| | | | |
|---|---|---|---|
| 4,154,649 | 5/1979 | Stotz et al. | 162/347 |
| 4,280,870 | 7/1981 | Bubik et al. | 162/344 |
| 4,373,993 | 2/1983 | Fujiwara | 162/344 |
| 4,731,163 | 3/1988 | Ilmoniemi | 162/344 |
| 4,915,789 | 4/1990 | Munch et al. | 162/259 |

OTHER PUBLICATIONS

Fourdrinier Papermaking (1963); Lockwood Trade Journal Co.; p. 60 and Cover Sheet.

Tappi Notes; 1986, Wet End Operation Seminar; pp. 61, 64 & 68 and Cover Sheet.

Paper Machine Crew Operating Manual; J. Mardon et al., Revised First Ed. (1963); Cover Sheet and 5 selected pages.

*Primary Examiner*—Karen M. Hastings

[57] ABSTRACT

Use of a headbox with an auxiliary blade having a concave edge reduces the deflection required to modify the basis weight profile of a wet sheet formed in papermaking apparatus.

1 Claim, 3 Drawing Sheets

HEADBOX WITH CONCAVE AUXILIARY BLADE

BACKGROUND OF THE INVENTION

Papermaking apparatus commonly includes a source of aqueous stock containing fibrous solids, a headbox to which the aqueous stock is supplied and a continuous wire belt upon which the headbox discharges a controlled amount of the aqueous stock which is at least partially dewatered by draining through the belt. In addition to the foregoing, there is ordinarily a press which squeezes the water out of the wet paper sheet and finally steam heated rolls which dry and consolidate the paper.

As the uncalendered sheet is calendered and passes through the high temperature/high pressure calender workroll the sheets of certain paper precursors may shrink significantly in the cross-machine direction. The shrinkage increases as the edge of the sheet is approached and a disproportionately high basis weight and thickness at the edges of the calendered sheet may result.

It is also common in papermaking equipment to find two blades defining the discharge opening of the headbox. One, referred to herein as the main blade, extends along the width of the headbox and is vertically moveable to control the size of the discharge opening. The second or auxiliary blade is a straight-edged blade moveably attached to the main blade. It moves with the main blade but is separately adjustable. The auxiliary blade is generally made of steel and can be flexed slightly by adjustment of a plurality of spaced vertical rods, each with screw and worm gear which provide vertical deflection at the point where the rod is secured to the blade. By raising or lowering the main blade one can increase or decrease the velocity at which the stock leaves the headbox. The deflection of the auxiliary blade to accommodate the desired basis weight profile, particularly at the outermost positions frequently causes permanent deformation of the auxiliary blade as its elastic limit is exceeded. Fatigue problems in the metal may also result. This is discussed in Fourdrinier Papermaking , a monograph by G. Gavelin 1963 Lockwood Trade Journal, Inc. and TAPPI Noles 1986 Wet End Operations Seminar. The present invention offers a solution to the problem. cl THE DRAWINGS FIG. 1 is a general schematic layout of that part of the prior art papermaking equipment under consideration.

SUMMARY OF THE INVENTION

In a papermaking apparatus comprising a headbox having means to receive an aqueous stock containing fibrous solids and an opening along one wall for discharging a layer of the aqueous stock;

a continuous wire belt cooperating with said headbox to receive and drain the layer of aqueous stock as it is discharged from the headbox;

a main blade disposed parallel to and adjacent the headbox wall having the discharge opening, said blade being vertically moveable and capable of changing the height of the discharged layer as it exits the discharge opening; and an elongated auxiliary blade having a preshaped concave edge extending in the direction of elongation of the blade, said blade being located downstream of and moveably attached to the main blade and extending across the width of the discharge opening of the headbox wall so that it is capable of modifying the basis weight profile of the discharged layer, said auxiliary blade having flexing means at space points along its length to modify the curvature of the edge.

DETAILED DESCRIPTION OF THE INVENTION

Figure 1:
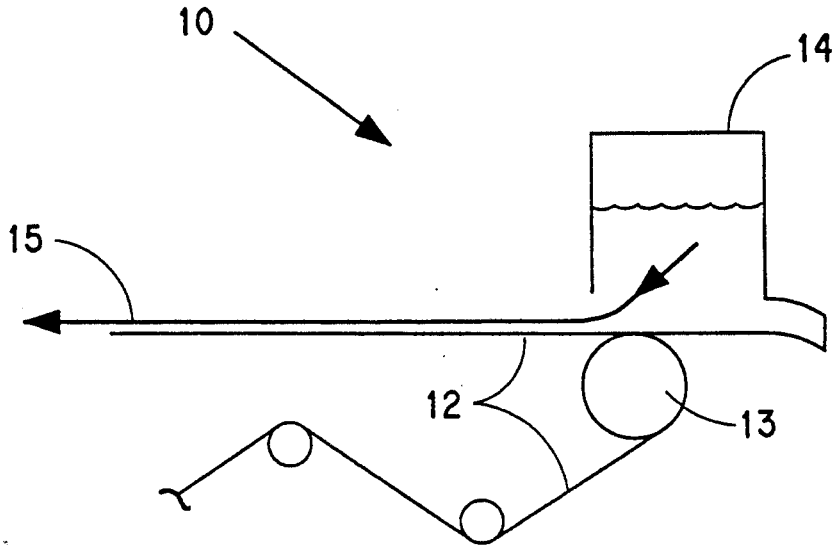

With reference to FIG. 1, apparatus 10 represents a papermaking machine of the Fourdrinier type in which a generally horizontal wire belt 12 is moved by means of rolls 13 under a headbox 14. An aqueous stock containing fibrous solids is fed to the headbox and discharged from the headbox 14 to form a wet sheet 15 on the wire. The wet sheet 15 is dewatered at least partially on the wire belt 12. The sheet 15 ultimately leaves wire belt 12 and enters a wet press section (not shown) in which the sheet is further dewatered and then passed to a series of steam heated dryer cans (not shown) and wound into a roll. The as-formed paper is then hot calendered using steel rolls (not shown).

Figure 2:
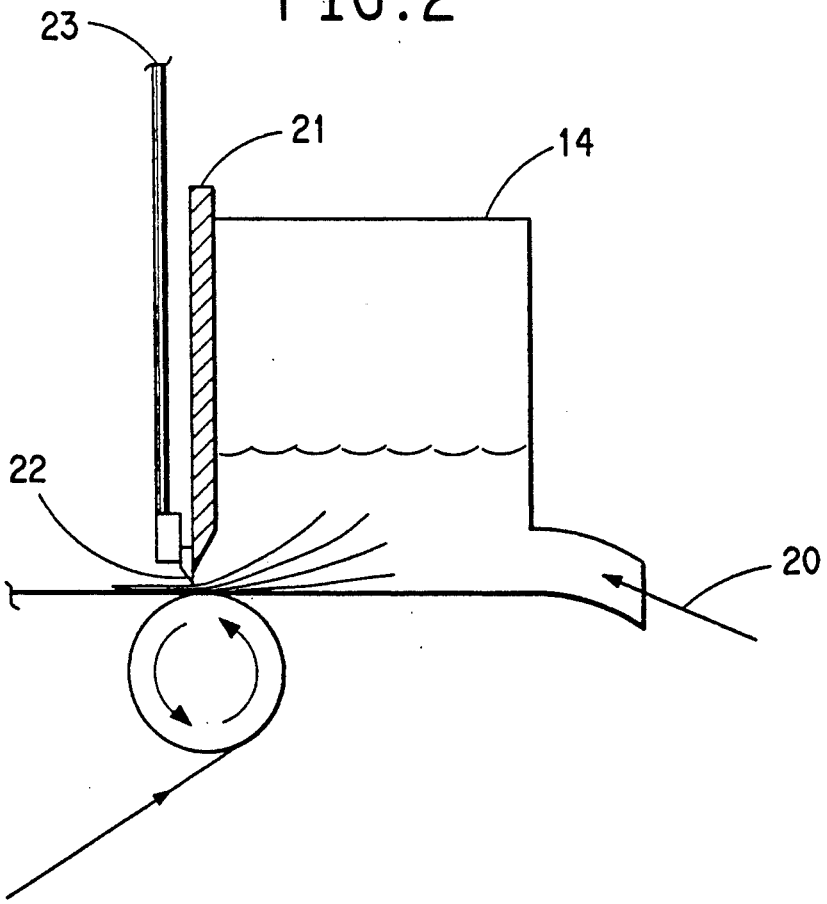
FIG. 2 is a sideview schematic of a headbox and its associated main and auxiliary blades as employed in the art.

Referring to FIG. 2, headbox 14 is shown in sideview with entrance means 20 for receiving aqueous stock. A side view of main blade 21 with moveably attached auxiliary blade 22 which define the discharge from the headbox 14. Also shown in sideview is the column of adjustment control rods 23 which are secured to the auxiliary blade and are used to deflect the blade along its length to modify the basis weight profile of the sheet.

Figure 3:
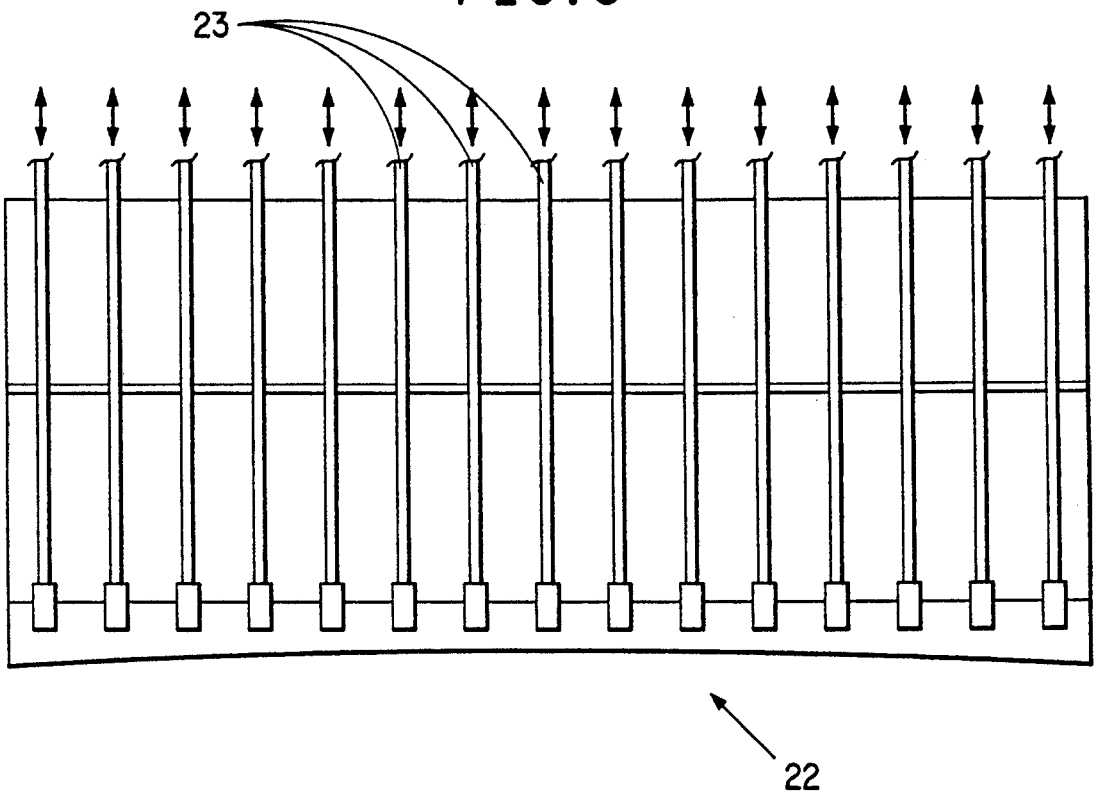
FIG. 3 is a schematic view of the auxiliary blade employed in the present invention and the vertical adjustment rods.

FIG. 3 shows in greater detail, the auxiliary blade 22 to which are attached the vertical adjustment rods 23 commonly known as jackulator rods. Each rod is attached to the blade and can be separately lowered or raised to deflect the blade while the other rods are kept in a stationary position. As understood in the art, the raising or lowering of the rods is accomplished with screw and worm gear (not shown). Also shown is the direction in which the blade might be flexed to reduce taper at the edges of the sheet deposited on the moving wire screen belt (not shown)

Figure 4:
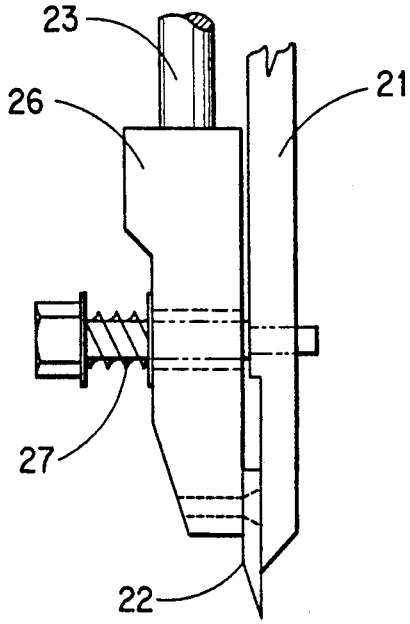
FIG. 4 is a schematic sideview showing how the auxiliary blade employed in the present invention is moved with respect to the main blade.

FIG. 4 is a detailed sideview schematic of the moveable attachment means connecting the auxiliary and main blades. The bracket 26 is attached to the main blade 21 by bolt 27 and allows for limited in-plane displacement of the auxiliary blade 22 with respect to the main blade 21. Rod 23 which may be adjusted up or down to bend the auxiliary blade slightly in its own plane.

Figure 5:
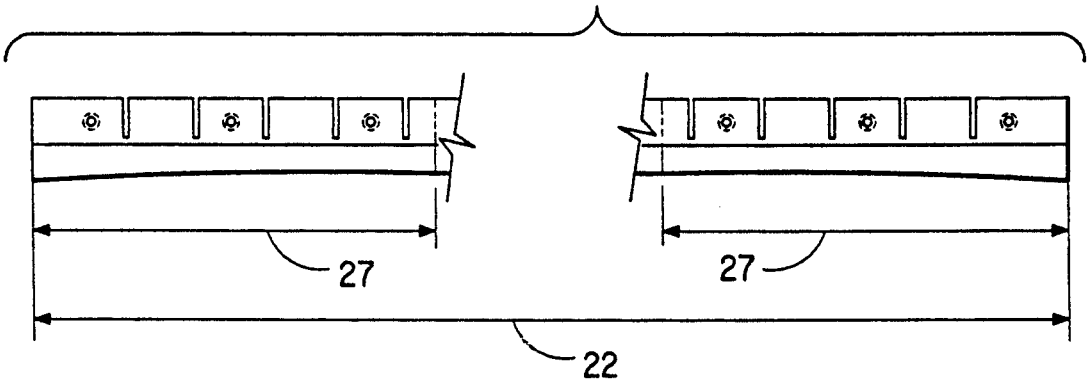
FIG. 5 is a schematic front view of the concave blade employed in this invention.

FIG. 5 is a schematic front view of the auxiliary blade 22 employed in the apparatus of this invention. Shown are the concave edge 27 of the blade and the points along the length of the blade where the adjustment rods are attached.

Use of the previously employed straight-edged auxiliary blade presented significant problems. The ability to taper the outer edges of the wet sheet were severely limited. The blade which is generally made of stainless steel, is rather rigid and can be flexed only slightly if it is to fully recover when the stress is removed. Exceeding the elastic limit of the blade causes permanent deformation thus exacerbating a difficult situation and presenting greater problems in subsequent efforts to adjust the basis weight profile of the wet sheet. By use of an auxiliary blade having a concave edge greatly reduces the deformation of the blade needed to achieve the desired profile. The concave edge permits regular deformation of the blade within its elastic deformability and without excessive or undue bending stress occuring at some location along its length. Any further adjustments are only slight and would not require the extensive flexing required heretofore.

We claim:

1. In a papermaking apparatus comprising a headbox having means to receive an aqueous stock containing fibrous solids and an opening along one wall for discharging a layer of the aqueous stock;

a continuous wire belt cooperating with said headbox to receive and drain the layer of aqueous stock as it is discharged from the headbox;

a main blade disposed parallel to and adjacent the headbox wall having the discharge opening, said blade being vertically moveable and capable of changing the height of the discharged layer as it exits the discharge opening; and an elongated auxiliary blade having a preshaped concave edge extending in the direction of elongation of the blade, said blade being located downstream of and moveably attached to the main blade and extending across the width of the discharge opening of the headbox wall so that it is capable of modifying the basis weight profile of the discharged layer, said auxiliary blade having flexing means at space points along its length to modify the curvature of the edge.

* * * * *